United States Patent [19]

Hegler et al.

[11] Patent Number: 4,930,936

[45] Date of Patent: Jun. 5, 1990

[54] PARTIAL-SEEPAGE DRAINAGE PIPE WITH MATING SLEEVE

[75] Inventors: Wilhelm Hegler, Goethestrasse 2, D-8730 Bad Kissingen; Ralph-Peter Hegler, Bad Kissingen, both of Fed. Rep. of Germany

[73] Assignee: Wilhelm Hegler, Bad Kissingen, Fed. Rep. of Germany

[21] Appl. No.: 577,260

[22] Filed: Feb. 6, 1984

[30] Foreign Application Priority Data

Apr. 12, 1983 [DE] Fed. Rep. of Germany ..... 3313147

[51] Int. Cl.[5] ..... F16L 31/00; E02B 11/00

[52] U.S. Cl. ..... 405/49; 405/43; 405/45; 405/44; 285/330; 285/423

[58] Field of Search ..... 405/36, 43, 44, 45, 405/49, 51; 285/423, DIG. 4, DIG. 22, 330; 138/121, 105

[56] References Cited

U.S. PATENT DOCUMENTS 3,681,925 8/1972 Schmunk et al. ..... 405/49
3,682,502 8/1972 Corriston et al. ..... 285/423 X
3,899,198 8/1975 Maroschak ..... 285/DIG. 4
3,958,425 5/1976 Maroschak ..... 405/49
4,140,422 2/1979 Crumpler ..... 405/49

FOREIGN PATENT DOCUMENTS 2262994 7/1974 Fed. Rep. of Germany ..... 405/43
2533968 2/1977 Fed. Rep. of Germany ..... 405/43

*Primary Examiner*—Randolph A. Reese
*Assistant Examiner*—Franco Deliguori
*Attorney, Agent, or Firm*—Browdy and Neimark

[57] ABSTRACT

A partial-seepage drainage pipe includes a wall surface of circular profile which is corrugated over the majority of the pipe circumference. Adjoining the circular wall surface is a base having a bottom surface and side wall segments. The pipe has a mating sleeve molded on in one piece at one end, which is adapted to receive the free end of a corrugated pipe segment and has slit-like water seepage openings in the corrugated wall surface.

In order to attain a tight mating-sleeve connection, the bottom surface of the base and the corresponding bottom surface of the mating sleeve are embodied such that they arch in a slightly convex fashion.

14 Claims, 1 Drawing Sheet

10
2
13
II
19
12
11
1
10
3
9
5
4
16
II
17
5'
18
14
5

8
19
3
15
9
α
β
$R_K$
$R_R$
7
5'
4
5
6

PARTIAL-SEEPAGE DRAINAGE PIPE WITH MATING SLEEVE

FIELD OF THE INVENTION

The present invention relates to a drainage pipe which has a corrugated, circular wall surface over the major portion of its circumference and over the remaining portion has an adjoining base with a bottom surface and side wall segments. A mating sleeve molded in one piece is at one end, adapted to receive the free end of a corrugated pipe segment. There are slit-like openings for water to seep through disposed in the corrugated portion of the wall.

BACKGROUND OF THE INVENTION

Drainage pipes having such seepage openings over part of their circumference have been known and available in commerce for over ten years. Because they have a single wall, they can be made of hard polyvinyl chloride (hard PVC). If the wall thicknesses are small, the waer seepage openings can be stamped. With wall thicknesses greater than 150 mm, the slit-like water seepage must be produced by sawing; as a necessary consequence, the seepage openings extend over from 25° to 35° of the circumference. These known pipes have several disadvantages. When a corrugated pipe segment is inserted into a sleeve embodied on the mating end of a corresponding pipe segment, the bottom surface of the pipe base arches inward, resulting in a leaky connection. Particularly with drainage pipe segments of relatively large wall thicknesses, however, sleeve connections which are watertight are required. Even if a sealing ring is also introduced into a groove, the connection is not tight. The shape stability of the pipes is generally reduced by the sawing of the relatively long, slit-like water seepage openings, which in turn again makes it more difficult to attain a firmly seated and completely tight sleeve connection. Furthermore, stones pressed into the pipe between the crests of the corrugations can cause the long slit-like seepage openings to spread apart substantially, allowing small stones and soil to get into the pipes; over the long run, this can result in complete clogging of the pipe. The only way to prevent such widening of the long slit-like seepage openings is to form the pipes such that the wall in the area of the openings is relatively thick; this, however, necessitates an undesirably high consumption of raw material.

It is true that double-walled drainage pipes, which comprise a corrugated outer pipe and a smooth inner pipe, do not have the above disadvantages; however, such double-walled pipes are extraordinarily expensive, particularly since they cannot be made of PVC, but can only be made of polyethylene.

From German laid-open application DE-OS 32 00 081 (corresponding to co-pending U.S. application No. 453,468), it is known to provide drainage pipes, both of the single-walled type discussed at the outset and the double-walled type that is smooth on the inside, with slit-like water seepage openings disposed in the troughs of the corrugations, extending over only a very short arc of the circumference and accordingly impairing the compression resistance of the crests of the corrugations, as well as the shape stability of the pipe, only slightly.

SUMMARY OF THE INVENTION

It is accordingly a principal object of the present invention to provide a tight-fitting connection for mating partial-seepage draining pipes of the type discussed above.

This object is attained in accordance with the invention by providing both the bottom of the base of one pipe and the bottom of the sleeve of a mating pipe with a slightly convexly arched surface. It is thereby attained that when a pressure bond is established between the base of the one pipe and the bottom of the sleeve of the mating pipe, the bottom surfaces press against one another in the same direction, that is, outward; thus a space or separation through which water could pass is not created between the two bottom surfaces. The invention provides for the curvature of the bottom surfaces to be very slight.

This object is further attained, in combination with the above provisions, by providing the sleeve of the mating pipe with a section which tapers conically, before its transition to the corrugated pipe segment, from slightly larger, to slightly smaller than the shape of the pipe segment. In this way, the pipe segment is pressed uniformly, and over a large surface area, against the inside of the mating sleeve. Introducing the pipe segment into the mating sleeve is made easier by providing a widened section at the free end of the sleeve of the mating pipe. The invention also provides that the water seepage openings extend over only a very slight angle of the circumference of the pipe, so that as a result of the foregoing provisions, the slits are not spread apart and the compression resistance of the pipe at its crests is virtually unimpaired. This provision also contributes to maintaining uniform pressure exerted between the mating sleeve and the pipe segment, which in turn means that particularly simple and good-quality luting can be attained. The disposition of short ribs between the short water seepage openings makes it possible for the bottom surface to be three to five times thicker than the corrugated circular wall surface. This is a result of the manufacture of the pipe; when the plastic hose emerges warm from the extruder, it is formed with thicker walls in the area from which the base will be molded than in the area from which the circular wall surface will be molded. Upon deformation of the circular portion into the corrugated form, the wall thickness is reduced once again. The ratios of the wall thicknesses according to the present invention, however, are even higher than this. Without using additional raw material, the area of the base is made stiffer by increasing the wall thickness there, causing the effects produced by the arching of the bottom surfaces to be still further reinforced.

Further advantages and characteristics of the invention will become apparent from the ensuing description of an exemplary embodiment of the invention, taken in conjunction with the drawings.

DESCRIPTION OF THE PREFERRED EMBODIMENT

Figure 2:
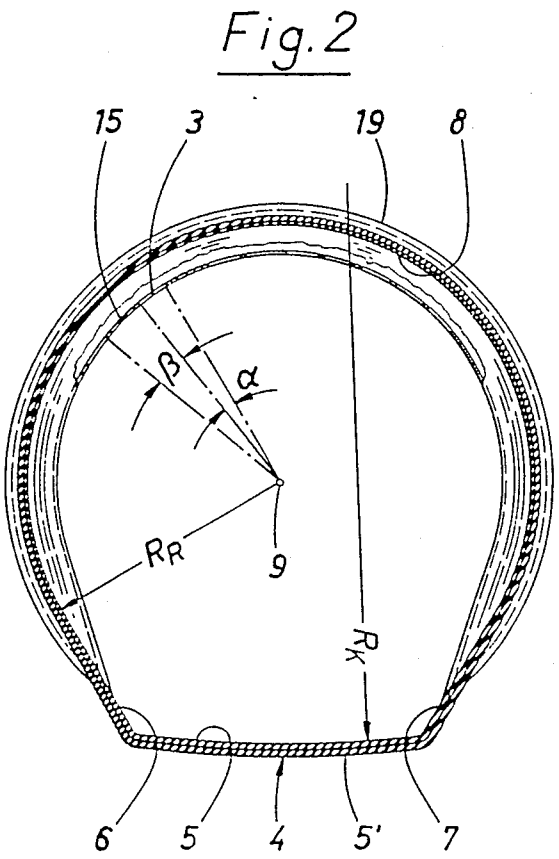
FIG. 2 is a cross section taken through the pipe segments of FIG. 1 along the line II—II.

The pipe segments 1, 2 shown connected with one another in the drawings each comprise a so-called partial-seepage pipe, that is, a drainage pipe that is provided with water seepage openings 3 over only a portion of its circumference. As shown in FIG. 2, the pipe segments 1, 2 have a circular cross section over approximately three-quarters of their circumference. The remaining portion of the circumference comprises a base 4, the bottom surface 5 of which extends approximately at a tangent to a continuation of the circumference. From the bottom surface, two side wall segments 6, 7 merge at a tangent with, and into, the circular wall surface 8, the distance between the side wall segments 6, 7 widening as they extend from the base to the circular wall surface 8.

Figure 1:
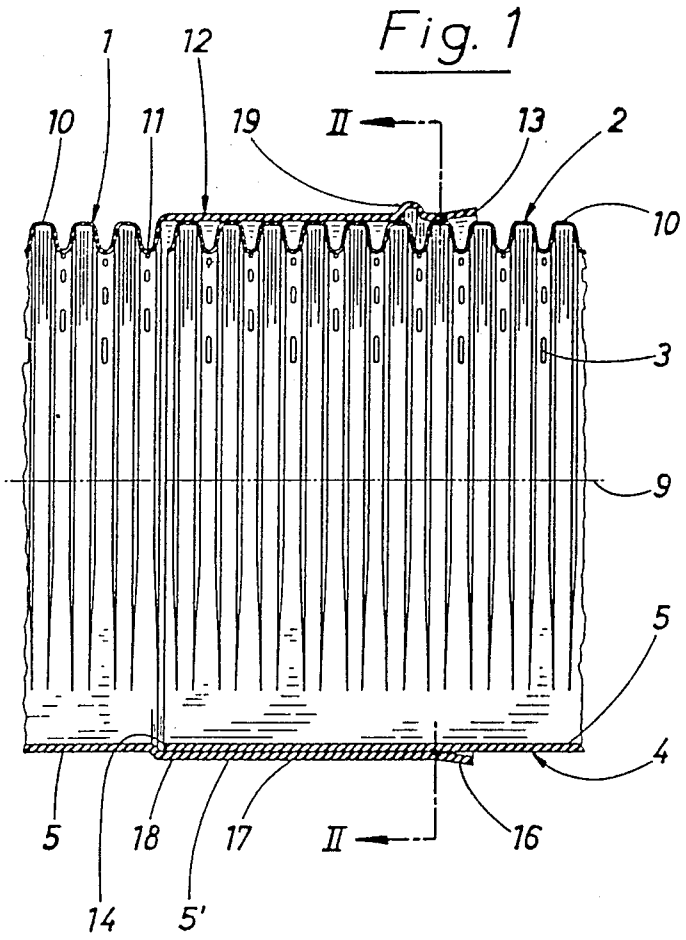
FIG. 1 shows two pipe segments with a mating sleeve connection, seen in a longitudinal section.

As seen in FIG. 1, the pipe is a so-called circular-corrugated type; that is, the pipe segments 1, 2 have in their respective circular wall surfaces 8, at planes located perpendicular to the central longitudinal axis 9, corrugation crests 10 and troughs 11 in the form of partial rings.

One pipe segment 1 includes a mating sleeve 12 molded thereon, the inside cross section of which corresponds—except for features to be discussed in greater detail below—to the outside cross section of the respective corrugated pipe segment. The corrugated segments of the pipe segments 1, 2 have an identical cross-sectional profile over their entire length. Such pipes are produced continuously from a still-warm hose extruded by an extruder. While still warm and plastic, the hose is introduced into an apparatus in which it is deformed by being pressed, from the inside by compressed air or from the outside by a vacuum, against revolving halves of a matrix having the appropriate shaping. Mating sleeves of this kind are formed by molding a smooth-walled segment in between corrugated segments of appropriate length, which as a rule is several meters. By severing a short transitional segment between the free end 13 of the sleeve of the one pipe segment 1 and the free end 14 of the other pipe segment 2, the latter end 14 terminating in a corrugation trough 11, two pipe segments 1, 2 are then obtained, with one mating sleeve 12 embodied on one end of each pipe segment. To the extent described thus far, the pipe segments 1, 2 with the mating sleeve 12 and their manufacture are generally known and conventionally found on the market.

The water seepage openings 3 in the upper area of the respective circular wall surface 8 of each pipe segment 1, 2 are located in the respective corrugation troughs 11 and extend in the circumferential direction. They are each embodied as relatively short slits, extending over an angle $\alpha$ of the circumference of only 6°–12°. The rib 15 located between and separating each two adjacent seepage openings 3 in one corrugation trough 11 extends over an angle $\beta$ of the circumference of 5°–10°. Short, slit-like seepage openings 3 in the corrugation troughs 11 are produced by a technique described in German Patent Application P 32 00 081.2. Since the openings 3 are so short in length, any stones getting into the troughs 11 when the drainage pipes are laid are prevented from spreading these openings apart in the longitudinal direction. Furthermore, the reduction of compression resistance of the crests of the pipe is reduced to a minimum by the disposition of the water seepage openings 3.

Because the reduction in compression resistance of the crests of the pipe segments 1, 2 is slight, the wall thickness in the area of the circular wall surface 8 can be reduced in comparison with pipe segments having longer water seepage openings, so that—without increasing the overall cost for raw materials—the wall thickness can be increased in the area of the bottom surface 5 and the side wall segments 6, 7.

As seen particularly from FIG.2, the corrugation, that is, the circular wall surface 8, extends relatively close to the bottom surface 5; in other words, the side wall segments 6, 7 not overlapped by the corrugation are relatively short. This feature again contributes to an increase in the rigidity of the profile and thus to an increase in the compression resistance at the crests of the entire pipe segment 1 or 2.

As shown in FIG. 2, the bottom surface 5 of a given pipe segment 1 or 2, and in corresponding fashion the bottom surface 5′ of the mating sleeve 12 as well, are curved outward slightly, the radius of curvature $R_K$ being from three to five times as large as the radius $R_R$ of the circular wall surface 8 of the respective pipe segment 1 or 2.

The mating sleeve 12 has a short, conically widened section 16 in the vicinity of its free end 13. Section 16 has a pronounced oversize with respect to the outer profile of the pipe segment 2, so that the latter can be introduced easily into the mating sleeve 12. Conically widened section 16 is adjoined by a section 17 which has a constant cross section over its entire length; the inner profile of this section 17 is larger than the outer profile of the pipe segment 2 by only a few tenths of a millimeter, so that introducing the pipe segment 2 into this section is accomplished substantially, but not entirely, without play. Extending from the end of section 17 to the corrugated section of the pipe segment 1 is a section 18 which tapers slightly; this section tapers down form the oversize of a few tenths of a millimeter mentioned above to an undersize of a few tenths of a millimeter, so that the pipe segment 2 is introduced such that its free end 14 exerts pressure all around its circumference against the inside of the mating sleeve 12. Since the bottom surfaces 5, 5′ are slightly convexly arched, the mutual pressure exerted during the introduction of the segment into the sleeve is reinforced until the press fit is attained; the bottom surface 5 thus does not separate from the bottom surface 5′.

Before the introduction of the free end 14 of the pipe segment 2 into the mating sleeve 12, the inner surface of the sleeve can be provided with a suitable plastic cement, in particular in the vicinity of the sections 17, 18; this cement acts as a lubricant as the segment is pushed into the sleeve, and contributes to a particularly tight and firm connection, because, as shown, the pipe segment 2 all around its circumference including its corrugation crests 10, its side wall segments 6, 7 and bottom surface 5 rests tightly and firmly against the corresponding inside surface of the mating sleeve 12.

At the transition from section 16 which widens outward in conical fashion to section 17 of constant cross section of the mating sleeve 12, a reinforcement rib 19 is provided. The single-walled pipe segments 1, 2 with the mating sleeve 12 are made of hard PVC.

It is understood that the foregoing text and drawing relate to an embodiment of the invention which is given by way of example but not limitation. Various other embodiments and variants are possible within the spirit and scope of the invention.

What is claimed is:

1. A partial-seepage drainage pipe comprising a plurality of similarly shaped pipe segments, each pipe segment including a corrugated, circular profile wall surface extending over the majority of the circumference of said segment, and a base having a bottom surface and side wall portions, each pipe segment further including a mating sleeve molded thereon at one end for receiving the free end of another pipe segment, each pipe segment having slit-like water seepage openings disposed in the corrugated wall surface, said pipe segments each comprising:

the bottom surface being slightly convexly arched, and the thickness of the bottom surface being three to five times the thickness of said circular profile wall surface.

2. A drainage pipe as defined by claim 1, wherein said bottom surface of each pipe segment and said circular profile wall surface each have a radius of curvature, the radius of curvature of said bottom surface being approximately three to five times as large as the radius of curvature of said circular profile wall surface.

3. A drainage pipe as defined by claim 2, wherein said mating sleeve of each segment has an inner diameter greater than the outer diameter of the corrugated wall surface and includes a section extending to the corrugated wall surface which tapers slightly in conical fashion from said sleeve diameter to a diameter slightly smaller than the outer diameter of said corrugated wall surface.

4. A drainage pipe as defined by claim 3, wherein said mating sleeve includes a free end having a conical widened introduction section defining means for receiving said another pipe segment.

5. A drainage pipe as defined by claim 2, wherein said mating sleeve includes a free end having a conical widened introduction section defining means for receiving said another pipe segment.

6. A drainage pipe as defined in claim 1, wherein said mating sleeve of each segment has an inner diameter greater than the outer diameter of the corrugated wall surface and includes a section extending to the corrugated wall surface which tapers slightly in conical fashion from said sleeve diameter to a diameter slightly smaller than the outer diameter of said corrugated wall surface.

7. A drainage pipe as defined by claim 3, wherein said mating sleeve includes a free end having a conical widened introduction section defining means for receiving said another pipe segment.

8. A drainage pipe as defined by claim 1, wherein said mating sleeve includes a free end having a conical widened introduction section defining means for receiving said another pipe segment.

9. A drainage pipe as defined by claim 1, wherein said water seepage openings each extend over an angle $\alpha$ of said circumference of only 6° to 12°.

10. A drainage pipe as defined by claim 9, wherein said water seepage openings each extend over an angle $\alpha$ of said circumference of only 7° to 10°.

11. A drainage pipe as defined by claim 10, wherein a rib is disposed between each two adjacent seepage openings and extends in the circumferential direction, each said rib extending over an angle $\beta$ of said circumference of 5° to 10°.

12. A drainage pipe as defined by claim 9, wherein a rib is disposed between each two adjacent seepage openings and extends in the circumferential direction, each said rib extending over an angle $\beta$ of said circumference of 5° to 10°.

13. A drainage pipe as defined by claim 1, wherein a corrugation rib is disposed between each two adjacent seepage openings and extends in the circumferential direction, each said rib extending over an angle $\beta$ of said circumference of 5° to 10°.

14. A pipe segment adapted for mating engagement with at least another correspondingly-shaped pipe segment to form a drainage pipe, said pipe segment comprising:

(a) a tubular element having a first end, a second end, and a wall having a corrugated area extending between the first and second ends, and (b) a mating sleeve molded on one of the first or second ends of the tubular element for receiving one of the second or first ends, respectively, of said another pipe segment, said tubular element wall including a cross-sectional profile having first and second portions, (1) the first portion comprising a circular segment extending over the majority of the circumference of the tubular element, and (2) the second portion comprising a base segment and side wall segments, the side wall segments each having one end connected to the base segment and an opposite end extending away from one another and merging tangentially with a respective end of the circular segment of said first portion;

the bottom surface of each of said pipe segments being slightly convexly arched, and the thickness of the bottom surfaces being three to five times the thickness of said circular segment.

* * * * *